US006105772A

United States Patent [19]

Goldman et al.

[11] Patent Number: 6,105,772

[45] Date of Patent: Aug. 22, 2000

[54] ARTIFICIAL AQUARIUM PLANT PACKAGE

[75] Inventors: Marvin Goldman, North Hills; Gerald Phillips, Wantagh; John Cummings, Copiague, all of N.Y.

[73] Assignee: Penn-Plax, Inc., Garden City, N.Y.

[21] Appl. No.: 09/124,965

[22] Filed: Jul. 30, 1998

[51] Int. Cl.[7] ..... B65D 85/50

[52] U.S. Cl. ..... 206/423; 206/461; 206/471

[58] Field of Search ..... 206/349, 423, 206/461, 467, 471, 495; D9/415, 457

[56] References Cited

U.S. PATENT DOCUMENTS

| | | | |
|---|---|---|---|
| D. 282,819 | 3/1986 | Laurent et al. | D9/415 |
| 3,139,182 | 6/1964 | Edell | 206/471 |
| 3,809,226 | 5/1974 | Ferrari . | |
| 4,039,079 | 8/1977 | Laughton | 206/461 |
| 4,453,629 | 6/1984 | Goldberg . | |
| 4,854,450 | 8/1989 | Fisher . | |
| 4,867,304 | 9/1989 | Garcia | 206/461 |
| 5,501,330 | 3/1996 | Betts | 206/349 |
| 5,613,605 | 3/1997 | Angeles et al. . | |

FOREIGN PATENT DOCUMENTS

| | | | |
|---|---|---|---|
| 327479 | 8/1989 | European Pat. Off. | 206/461 |
| 927035 | 5/1963 | United Kingdom | 206/467 |

*Primary Examiner*—David T. Fidei
*Attorney, Agent, or Firm*—Nikaido, Marmelstein, Murray & Oram LLP

[57] ABSTRACT

A plant package for an artificial aquarium plant including a card member having a front face and a shaped shell member affixed to the front face by a peripheral bonding flange. The shell member has an upper section including a plant base holding pocket with a top edge. The top edge is free of the card member. The bottom portion of the plant base holding pocket is shaped to confine a base of the artificial aquarium plant with the top portion being restricted and shaped to overlay and support one or more plant stems of the artificial aquarium plant. A lower section of the shell member is designed with raised ridges reinforcing the shell member and defining an indicia window portion.

11 Claims, 2 Drawing Sheets

ARTIFICIAL AQUARIUM PLANT PACKAGE

BACKGROUND OF THE INVENTION

The present invention relates to a package for artificial aquarium plants, and more particularly, to a semi-sealed plant package for especially effectively displaying artificial aquarium plants in retail stores.

Artificial aquarium plants are known which are made comprising a weighted plant base, a plurality of plant stems, and a variety of artificial leaves of various configurations and colors attached to the plant stems. These artificial aquarium plants are made of certain materials designed to appear to be especially real in an underwater environment in an aquarium. The texture of the leaves is rather unique. The most preferred artificial aquarium plants have fabric leaves. Because of the fabric construction, consumers strongly desire to feel the leaves, more so than if the leaves were of the more traditional molded plastic material. Additionally, these most preferred artificial aquarium plants are fuller and spread more than traditional molded plastic plants.

Various types of packages for displaying goods for retail sale are known. For goods of general fixed shapes, blister packages are known such as disclosed in U.S. Pat. No. 4,854,450 to Fisher. For live plants, requiring a large volume of interior space and a secure holding structure for the roots and rooting medium, a plant package is known comprising a self-supporting sealed polymer shell having a large interior compartment for displaying and protecting the above ground portions of the plant being sold as disclosed in U.S. Pat. No. 5,613,605 to Angeles et al. A shape conforming transparent molded polymer package is known for face masks as disclosed in U.S. Pat. No. 4,453,629 to Goldberg.

Generally, artificial aquarium plants have been packaged by strapping the stems of the plant to one surface of a cardboard sheet using a wire tie, thereafter wrapping the sheet over the plant base leaving an opening through which the plant stems and leaves extend and gluing or otherwise adhering the folded over paper or cardboard to itself. The front and back surfaces of the paper or cardboard carry the indicia concerning the product while the artificial plant leaves extend upwardly out of the opening in the front face of the package.

These packages for artificial aquarium plants are subject to certain difficulties in that the lateral edges of the opening on the front face of the package tend to rip during transport and display. The plant base is not secured. The wire tie holding the plant stems permits vertical movement of the plant relative to the package which can result in the stem becoming damaged. Further, with the entire package being made of cardboard or paper, unsightly folds or wrinkles can occur during shipment leaving the overall package less desirable to a consumer. In addition, the opaque material forming the package covers and conceals the base of the plant, negating any decorative features that may be provided and making the plant less attractive to consumers.

As alternatives for packaging of aquarium plants, a regular blister pack is not readily workable. This is because the design of the blister pack and packaging of the same with the flexible, variable-orientation leaves is extremely time consuming and expensive. Further, the close confinement of the leaves of the artificial plants under the blister does not display the aquarium plant to its best advantage. This is especially difficult with respect to the fabric leafed artificial aquarium plants.

A large open interior polymer shell container such as those used for live plants would be possible. However, this would result in a very expensive, ungainly package. Specific shape conforming packages such as those used for face masks, for each of plural types would be extremely expensive. Further, the packing of the individual leaves would be time consuming and labor intensive. Further, in all of the cases of a conventional blister package or a polymer shell package or a shape conforming cover, the consumers would not be able to feel the texture of the leaves of the plants to determine if they were suitable.

OBJECT AND SUMMARY OF THE INVENTION

It is an object of the present invention to provide a plant package for an artificial aquarium plant which securely holds the base of the plant while permitting relatively free movement of the leaves to enable a consumer to feel the texture of the leaves of the plant.

It is another object of the present invention to provide a plant package which is secure from edge ripping.

It is the further object of the present invention to provide a plant package in which the stems of the plants are securely supported and the base of the plant is securely held.

These and other objects are obtained in a plant package for an artificial aquarium plant comprising a plant package for an artificial aquarium plant comprising a card member having a front face, and a shaped shell member having a peripheral bonding flange affixed to the front face of the card member. The shell member includes a lower section and an upper section. The upper section defines a plant base holding pocket having a top edge, with the top edge being free of said card member.

The plant base holding pocket can further include a top portion and a bottom portion, with the bottom portion being shaped to confine a base of the artificial aquarium plant, and the top portion being restricted and shaped to overlay and support one or more plant stems of the artificial aquarium plant.

The lower section can include raised ridges spaced from the card member reinforcing the shell member and defining an indicia window portion. The raised ridges can include two lateral ridges and a bottom ridge, with the indicia window portion being free of said card member.

The top edge can be scalloped for overlaying and supporting two or more plant stems.

The card member can be considered to have a lower portion and an upper portion, with the shell member being affixed to the lower portion of said card member. The upper portion can have a cut-out for hanging of the plant package. The card member can have at least two tie down holes therein positioned between the shell member and the cut-out.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
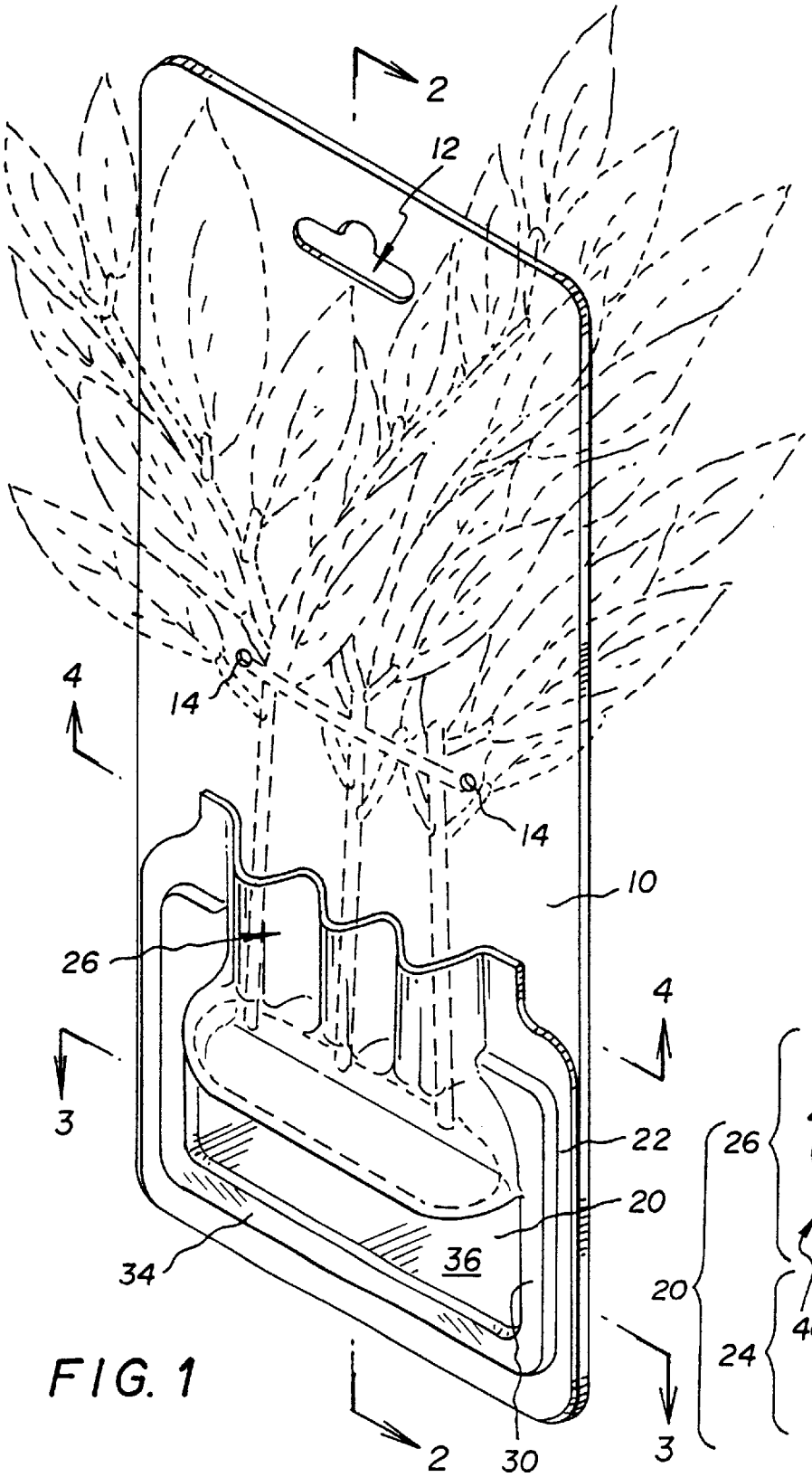
FIG. 1 is a perspective view of a first embodiment of a plant package according to the present invention.
Figure 2:
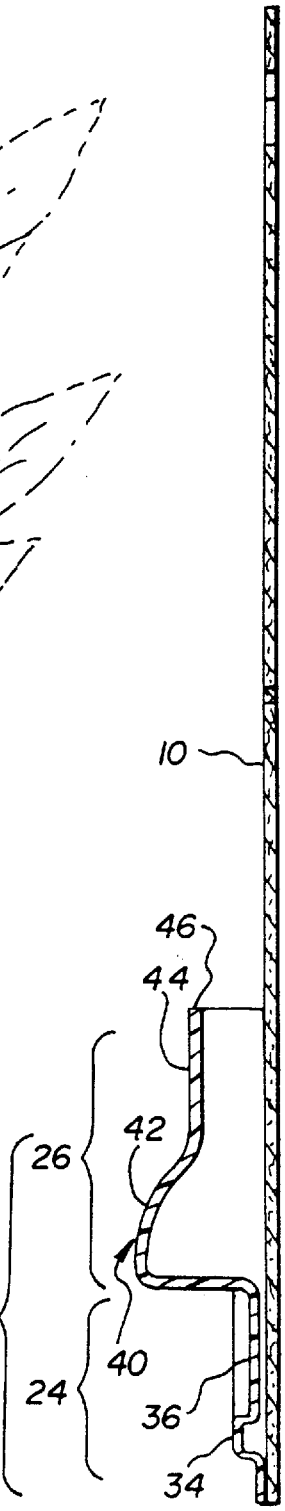
FIG. 2 is a cross-sectional view taken along lines 2—2 in FIG. 1.
Figure 3:
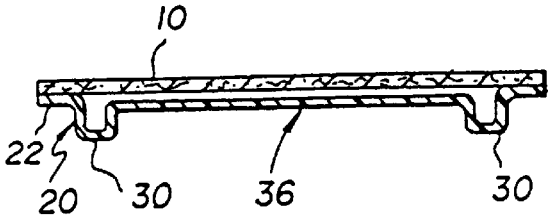
FIG. 3 is a cross-sectional view taken along lines 3—3 in FIG. 1.
Figure 4:
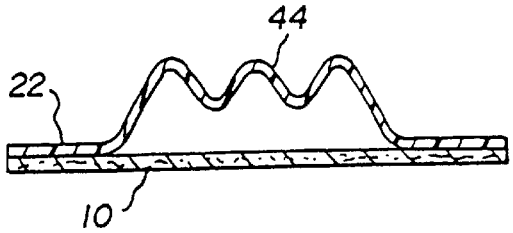
FIG. 4 is a cross-sectional view taken along lines 4—4 in FIG. 1.

Referring now in detail to the drawings, and more particularly to FIGS. 1–4, a plant package for an artificial aquarium plant is presented comprising a card member 10 and a shaped shell member 20.

The card member 10 has a front face on which the shell member 20 is mounted. The card member can be considered to have a lower portion and an upper portion. The shell member 20 is mounted on the lower portion. The upper portion has a cut-out 12 in the form of a slot passing therethrough. This permits a cylinder display hook to be used in which the card member 10 is mounted on the display hook in a conventional manner.

The card member 10 is composed of a thin, flat sheet of any self-form-maintaining material. Usually for the purpose of economy and ease of manufacture, the card member 10 is made of cardboard or paperboard. As a standard practice, the card member 10 is of a rectangular shape with rounded corners and is sized appropriately for the artificial aquarium plant to be held thereon. The front and the back of the card member 10 will be imprinted with various instructional indicia, trademarks, manufacturer identification, price information and so forth.

The shell member 20 has a lower section 24 and an upper section 26 with a peripheral bonding flange 22 extending therearound with the exception noted in the description below. The peripheral flange 22 is bonded to the card member 10 on the front face thereof in the usual manner such as by the use of an adhesive. Alternatively, the rear face of the flange 22 can be tackified, as by the application of a thin coating of a solvent, to render the back surface of the flange sufficiently sticky to adhere to the front face of the card member and upon evaporation of the solvent to be permanently attached thereto. Also, the flange 22 can be secured to the panel by the application of heat with or without pressure, the heat, for instance being supplied by high frequency heating.

The shell member 20 may be manufactured from polymer material, any one of the well known synthetic plastics being suitable for use. It is preferable that the shell member 20 be transparent enabling a clear view of the base of the artificial aquarium plant. As a suitable synthetic plastic, mentioned by way of example only are cellulose acetate, cellulose acetate butyrate, polystyrene, polystryene-butadiene, polyamide resins, acrylic resins, polyvinyl chloride. The shell member 20 is preferably manufactured by conventional vacuum forming of the polymer material into the desired shape through the application of heat and pressure. The techniques for doing so are well known to those of ordinary skill in the art. The shell member 20 can be of a standard thickness for such polymer materials and is designed to be sufficient to maintain the structures described hereinbelow.

The specific design of the shell member 20 includes the upper section 26. The upper section 26 has a plant base holding pocket 40 which is shaped and designed to specifically hold the plant base of the artificial aquarium plant. This plant base holding pocket 40 has a bottom portion 42 and a top portion 44. The bottom portion 42 bulges outwardly relative to the card member 10 and is semicircular shaped to conform to the general shape of the plant base. The top portion 44 is shaped to overlay and support the stem or stems of the particular artificial plant being held in the package.

In all embodiments, the top edge 46 of the upper section 26 of the shell member 20 is free of the card member. That is, as specifically defined in this application, the top edge 26 is not secured in any manner to the card member 10 in the portions overlaying and supporting the plant stems. There is no peripheral flange across the top edge 46.

The lower section 24 of the shell member 20 has a pair of raised lateral ridges 30 and a raised bottom ridge 34 joining the lateral ridges across the lowermost portion of the bottom portion of the card member 10. An indicia window portion 36 is defined between the two lateral raised ridges 30, the bottom raised ridge 34 and the lowermost portion of the bottom portion 42 of the plant base holding pocket 40. This indicia window portion 36 is free of the card member 10. The raised ridges serve the functions of reinforcing, stiffening, and defining the lower portion of the plant package. Additionally, these raised ridges by defining the indicia window portion provide a visual and tactile frame for unique manufacturers markings.

Additionally, for supporting the plant stems at a position between the shell member 20 and the cut-out 12, the card member 10 can have two or more tie down holes 14. These are for the purpose of using a wire tie (not shown) to secure the upper portions of the stems to the card member 10.

In the first embodiment shown in FIGS. 1–4, it is contemplated that the plant package would be used with an artificial aquarium plant having three individual, spaced apart stems. For this purpose, the top portion 44 of the plant base holding pocket 40 and the top edge 46 thereof are formed to be scalloped. That is, the top edge 46 and the top portion 44 have an undulating wave like structure designed to overlay and support the individual three plant stems.

Figure 5:
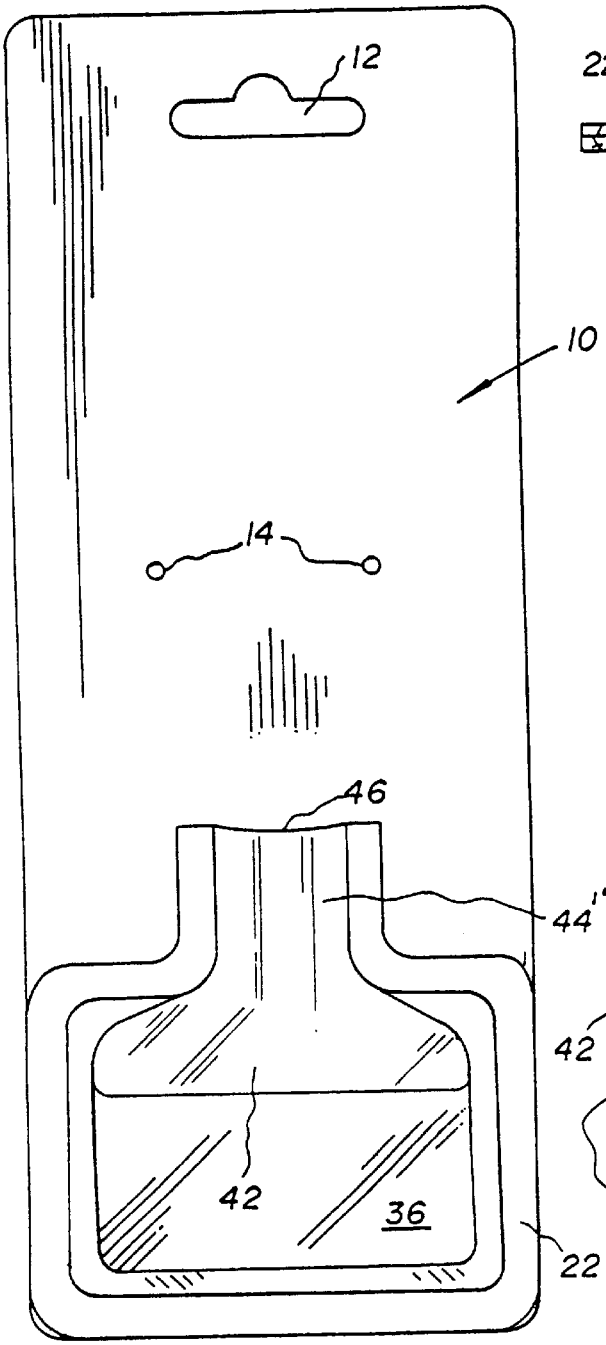
FIG. 5 is a front view of a second embodiment of the present invention suitable for a different style of aquarium plant.

In a second embodiment shown in FIG. 5, one or more plant stems can extend through a single undulation in the top portion 44'. This top portion 44' can be extended further up the card member 10 than would be necessary in the first embodiment. As noted, one or more plant stems can extend upwardly through this single undulation 44'.

Figure 6:
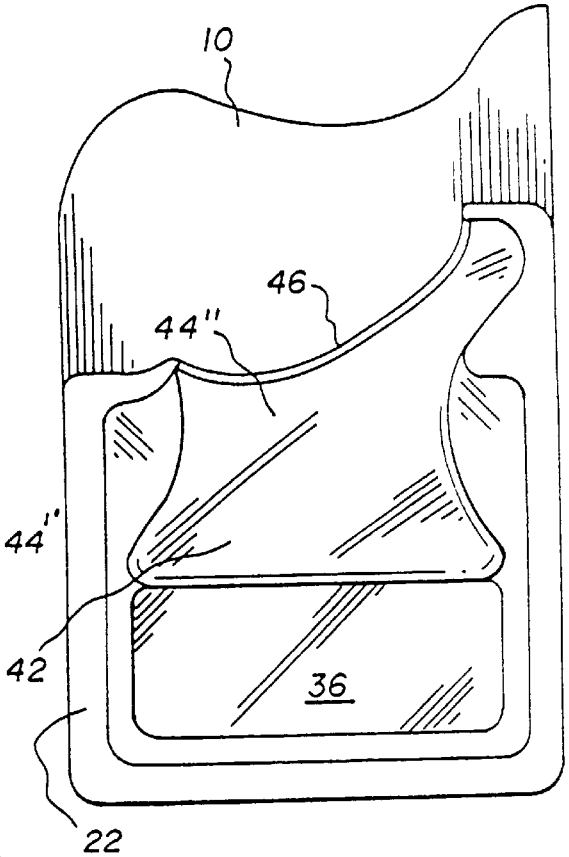
FIG. 6 is a partial front view of a third embodiment of a plant package for an artificial aquarium plant.

In a third embodiment shown in FIG. 6, if the artificial aquarium plant has a laterally or diagonally extending stem or stalk portion, the upper portion 44" of the plant base holding pocket 40 can be designed to overlay and support that additional stalk or stem in a generally form fitting manner.

As noted above, in all three embodiments, the top edge 46 of the top portion 44 of the plant base holding pocket 40 is free of the card member 10 and permits the stem or stems of the artificial aquarium plant to extend therethrough while being supported and overlayed. This enables the consumer to readily and easily feel the texture of the plant leaves while retaining and supporting the stems and the plant base in a secure manner. The plant package is readily displayable on a conventional card tree. The leaves of the plants are not confined.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. A plant package for an artificial aquarium plant comprising:

a card member having a front face, and a shaped shell member having a peripheral bonding flange affixed to the front face of the card member, said shell member covering over a portion of the front face of the card member, the majority of the front face of the card member being uncovered by said shell member, said shell member including a lower section and an upper section, said upper section defining a plant base holding pocket having a top edge, said top edge being free of said card member.

2. The plant package as claimed in claim 1, wherein said plant base holding pocket further includes a top portion and a bottom portion, said bottom portion being shaped to confine a base of the artificial aquarium plant, said top portion being restricted and shaped to overlay and support one or more plant stems of the artificial aquarium plant.

3. The plant package for an artificial aquarium plant comprising:

a card member having a front face, and a shaped shell member having a peripheral bonding flange affixed to the front face of the card member, said shell member including a lower section and an upper section, said upper section defining a plant base holding pocket having a top edge, said top edge being free of said card member, said lower section including raised ridges spaced from the card member reinforcing the shell member and defining an indicia window portion.

4. The plant package as claimed in claim 3, wherein said raised ridges include two lateral ridges and a bottom ridge, said indicia window portion being free of said card member.

5. The plant package as claimed in claim 2, wherein said lower section including raised ridges spaced from the card member reinforcing the shell member and defining an indicia window portion.

6. The plant package as claimed in claim 5, wherein said raised ridges include two lateral ridges and a bottom ridge, said indicia window portion being free of said card member.

7. The plant package as claimed in claim 2, wherein said top edge is scalloped for overlaying and supporting two or more plant stems, said scalloped top edge having ridges equal in number to said two or more plant stems.

8. The plant package for an artificial aquarium plant comprising:

a card member having a front face, and a shaped shell member having a peripheral bonding flange affixed to the front face of the card member, said shell member including a lower section and an upper section, said upper section defining a plant base holding pocket having a top edge, said top edge being free of said card member, wherein said card member has a lower portion and an upper portion, said shell member is affixed solely to the lower portion of said card member and the upper portion has a cut-out for hanging of the plant package.

9. The plant package as claimed in claim 8, wherein said card member has at least two tie down holes therein positioned between said shell member and said cut-out.

10. A plant package for an artificial aquarium plant comprising:

a card member having a front face, and a shaped shell member having a peripheral bonding flange affixed to the front face of the card member, said shell member including a lower section and an upper section, said upper section defining a plant base holding pocket having a top edge, said top edge being free of said card member, a top portion and a bottom portion, said bottom portion being shaped to confine a base of the artificial aquarium plant, said top portion being restricted and shaped to overlay and support one or more plant stems of the artificial aquarium plant, said lower section including raised ridges spaced from the card member reinforcing the shell member and defining an indicia window portion, said raised ridges including two lateral ridges and a bottom ridge, said indicia window portion being free of said card member, said card member having a lower portion and an upper portion, said shell member being affixed to the lower portion of said card member, the upper portion having a cut-out for hanging of the plant package, said card member further having at least two tie down holes therein positioned between said shell member and said cut-out.

11. The plant package as claimed in claim 10, wherein said top edge is scalloped for overlaying and supporting two or more plant stems.

* * * * *